US005082334A

United States Patent [19]

Beyer et al.

[11] Patent Number: 5,082,334

[45] Date of Patent: Jan. 21, 1992

[54] FOOD BREATH GUARD APPARATUS

[75] Inventors: Peter E. Beyer, Sheboygan; Robert E. Moran, Jr., Sheboygan Falls, both of Wis.

[73] Assignee: The Vollrath Company, Inc., Sheboygan, Wis.

[21] Appl. No.: 713,555

[22] Filed: Jun. 7, 1991

Related U.S. Application Data

[63] Continuation-in-part of Ser. No. 352,882, May 17, 1989, abandoned.

[51] Int. Cl.[5] ..... A47B 96/18

[52] U.S. Cl. ..... 312/140.4

[58] Field of Search ..... 312/140.4, 114, 138.1, 312/284, 287, 289

[56] References Cited

U.S. PATENT DOCUMENTS

| | | | |
|---|---|---|---|
| 3,915,525 | 10/1975 | Taube | 312/284 X |
| 4,013,880 | 3/1977 | Kennedy et al. | 312/140.4 |
| 4,572,598 | 2/1986 | Morre | 312/140.4 |
| 4,611,855 | 9/1986 | Daws | 312/284 X |
| 4,892,366 | 1/1990 | Yerman | 312/140.4 |

OTHER PUBLICATIONS

Dramatic Sneeze Guards, Nov. 1966.

*Primary Examiner*—Joseph Falk
*Attorney, Agent, or Firm*—Foley & Lardner

[57] ABSTRACT

A breath guard apparatus for protecting food displayed in a food service area comprises means including a side guard for shielding the displayed food, means for supporting the shielding means above the food service area and hinge means connecting the side guard to the supporting means so that the side guard can be rotated from a closed position which shields the displayed food to an open position which provides access to the food.

32 Claims, 2 Drawing Sheets

FOOD BREATH GUARD APPARATUS

This is a continution-in-part of application Ser. No. 07/352,882 filed May 17, 1989, now abandoned.

FIELD OF THE INVENTION

The present invention relates to food service equipment and, in particular, to a breath guard apparatus for protecting food displayed in a food service area.

BACKGROUND OF THE INVENTION

The use of self-service food equipment has increased dramatically in recent years due to the popularity of self-service dining. Customers prefer convenience and choice in selecting their food preferences. As a result, self-service food establishments strive to provide both.

In such self-service establishments, two types of food are typically offered: cold salad-type foods from a salad bar and hot entree-type foods from a buffet.

One fundamental problem encountered by self-service food establishments is that the food remains uncovered when displayed for selection by the customer. It is desirable to provide a barrier between the customer and the displayed food that reduces the risk of contaminating the food by airborne infections but which does not unduly restrict access to the food.

Transparent shields are often used in the food service industry as barriers over displayed food items. These shields are typically referred to as breath guards.

In fact, the local health codes of many communities require the use of breath guards in self-service food establishments. A typical health code will require that the displayed food be protected by a breath guard having a clearance of no more than about 9 inches (23 cm) between the lower portion of the breath guard and the top of the food service area.

Such breath guards have generally satisfied the health code regulations of many communities. In addition, the space between the breath guard and the food service area is usually adequate for self-serve customers to reach into the food service area and select their food. One problem associated with these breath guards, however, is the difficulty in cleaning the food service area. Moreover, because of space constraints, it is often difficult to replenish the supply of food in the serving pans and to replace empty serving pans.

In addition, many communities are implementing additional restrictions concerning the use of breath guards to further reduce the spread of airborne infections around displayed food. These restrictions can make it more difficult for the customer to reach the displayed food and more difficult to replenish or replace the serving pans.

The breath guard assemblies that are currently available have one or more significant disadvantages. For example, a salad bar apparatus described in U.S. Pat. No. 4,572,598 includes a transparent cover positioned over the displayed food. Although the cover adequately protects the food, the cover cannot be readily cleaned unless it is completely removed from its vertical supports. In addition, this type of breath guard assembly is mounted in a single position and cannot be positioned at different heights above the displayed food.

A breath guard apparatus is needed which provides the required sanitary protection for the food and complies with the most stringent local health codes but which allows the food to be replenished by the dining room attendants. Such an apparatus should also be easy to use, inexpensive to produce and durable.

SUMMARY OF THE INVENTION

The present invention provides a breath guard apparatus which protects food displayed in a food service area and provides ready access to the food service area for selection of the displayed food and for cleaning and replenishing purposes.

The breath guard apparatus comprises means for shielding the displayed food, means for supporting the shielding means above the food service area and hinge means connecting the shielding means to the supporting means so that the shielding means can be moved from a closed position to an open position. The shielding means can include one or more side guards which are preferably transparent and which can be rotated about the hinge means from the closed position to the open position. The closed position protects the displayed food but still allows access to the food service area for food selection purposes, and the open position provides access so that the food service area can be cleaned and replenished.

The supporting means can include a cover having a flange associated with an edge thereof which is adapted to receive a portion of the shielding means when the side guard is connected to the cover by the hinge means. This can be accomplished by attaching the hinge means to the side guard at a predetermined distance from the edge of the side guard corresponding to the distance that the side guard extends under the flange.

The apparatus can also include one or more end guards disposed below the cover and having at least one sloped edge extending downwardly and outwardly. The side guard rests on the sloped edge of the end guard when the apparatus is in the closed position.

The present apparatus thus provides the needed sanitary protection for a food service area but also allows for easy replenishing of the food and cleaning of the food service area by simply swinging the side guard upwardly.

One of the benefits of this invention is that the shielding means can be easily moved from a closed position which protects the displayed food to an open position which facilitates access to the food. The hinge arrangement avoids openings between the side guard and the cover to further protect the food from airborne infections.

Another benefit of the invention is the apparatus can be easily adjusted for height requirements depending on local health regulations concerning the distance between the lower end of the apparatus and the top of the food service area.

These benefits and other advantages of this invention will be apparent to those in the food service industry based on the following description, drawings and claims.

BRIEF DESCRIPTION OF THE DRAWINGS

In the drawings, which form a part of the description of the invention.

DETAILED DESCRIPTION OF A PREFERRED EMBODIMENT

Figure 1:
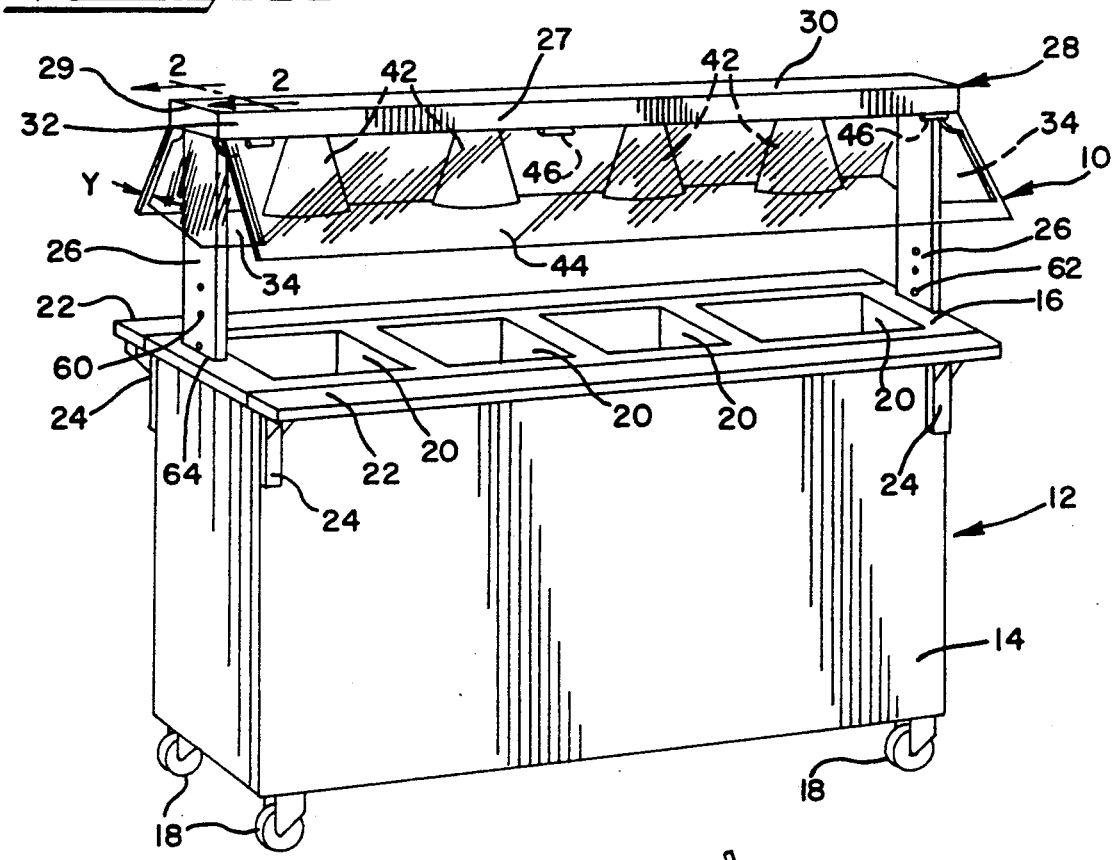
FIG. 1 is a perspective view of a preferred embodiment of a food service cart provided with a breath guard apparatus in accordance with the present invention.

Referring to FIG. 1, a breath guard apparatus in accordance with the present invention is designated generally by the reference numeral 10. The apparatus 10 is shown mounted on a rectangular mobile buffet cart 12, although other self-service food stations such as salad bars and the like are equally useful and are contemplated for use with the present invention.

The buffet cart 12 is a table-like structure which includes an exterior housing 14 and a countertop 16. The buffet cart 12 is supported by four wheels 18 which provide for easy mobility.

Inset in the countertop 16 of the buffet cart 12 is a plurality of wells 20. The wells 20 can include heating elements (not shown) which provide either dry heat or wet conductive heat obtained by hot water or steam. Serving pans (not shown) which contain the various food items can be positioned in the wells. Of course, if the food service area includes a salad bar, cooling means such as crushed or broken ice can be placed in the wells.

Along the longitudinal sides of the countertop 16 are provided plate rests or shelves 22 which are supported by a plurality of fold-down mounting brackets 24. The shelves 22 provide a place for the customer to rest a plate while selecting from the displayed food items.

The transverse sides of the countertop 16 include upright support members 26 which support the breath guard apparatus 10. A cover 28 is attached at the top of the support members 26 and extends between the support members. The cover 28 is preferably smaller in width than the countertop 16 and includes two longitudinal sides 27 and two transverse ends 29. The cover 28 has an upper surface which serves as a flat, horizontal top shelf 30 and extends downwardly from the sides of the top shelf 30 to define flanges 32.

Also attached to each support member 26 is an end guard 34. Each end guard 34 is generally pentagonal in shape having a horizontal edge 36 extending generally parallel to and below the top shelf 30, two sloped edges 38 which are inclined downwardly and outwardly from the cover 28 and two inwardly and downwardly sloped edges 40 which form the lower periphery of the end guard 34. This can best be seen in FIG. 2.

Suspended from the cover 28 is a plurality of fixtures 42, each being associated with one or more wells 20. The fixtures 42 can provide either light or heat, or both.

Side guards 44 extend along the longitudinal sides 27 of the cover 28. Each side guard 44 is generally rectangular and is preferably made of a suitable transparent material that is durable, easy to clean and relatively inexpensive. A good, suitable material has been found to about ¼ inch (7 mm) thick clear acrylic.

Referring again to FIG. 2, the side guards 44 are secured to the cover 28 by hinge means 46 which permits each side guard to be rotated upwardly to an open position or downwardly to a closed, food shielding position. When the side guard 44 is in the closed or food shielding position, the side guard freely rests on the sloped edges 38 of the end guards 34. In use, each end guard 34 thus functions both as a protective food shield and as a support for the side guards 44.

As previously mentioned, the clearance between the breath guard apparatus 10 and the food service area can often be as little as about 9 inches (23 cm) based on local health regulations. With the side guard 44 pivoted to the open position, the dining establishment attendants can freely clean the food service area or replenish food in empty pans.

In a preferred embodiment, the hinge means 46 comprises two members 48 and 50 connected by pivot means such as a hinge pin 52. The first member 48 is connected to the downwardly extending flange 32 of the cover 28 and the second member 50 is connected to the side guard 44 which can thus be rotated from the closed position shown on the left side of FIG. 2 to an open position shown on the right side of FIG. 2. When the side guard is in the open position, the side guard will extend past vertical, as seen on the right side in FIG. 2. This enables the side guard 44 to abut against the cover 28 when in the open position. The second member 50 is connected to the underside of the side guard 44 at a distance (X) extending from the upper edge 56 of the side guard 44 (when in closed position) to the hinge pin 52.

To enable rotation or pivoting of the side guard 44, the corner defined by the horizontal edge 36 and the sloped edge 38 includes a cutaway portion 54. The cutaway portion has a radius that is greater than the radius of the portion of the side guard 44 indicated by the distance (X). The cutaway portion 54 thus allows the side guard 44 to freely pivot about the hinge means 46.

Figure 2:
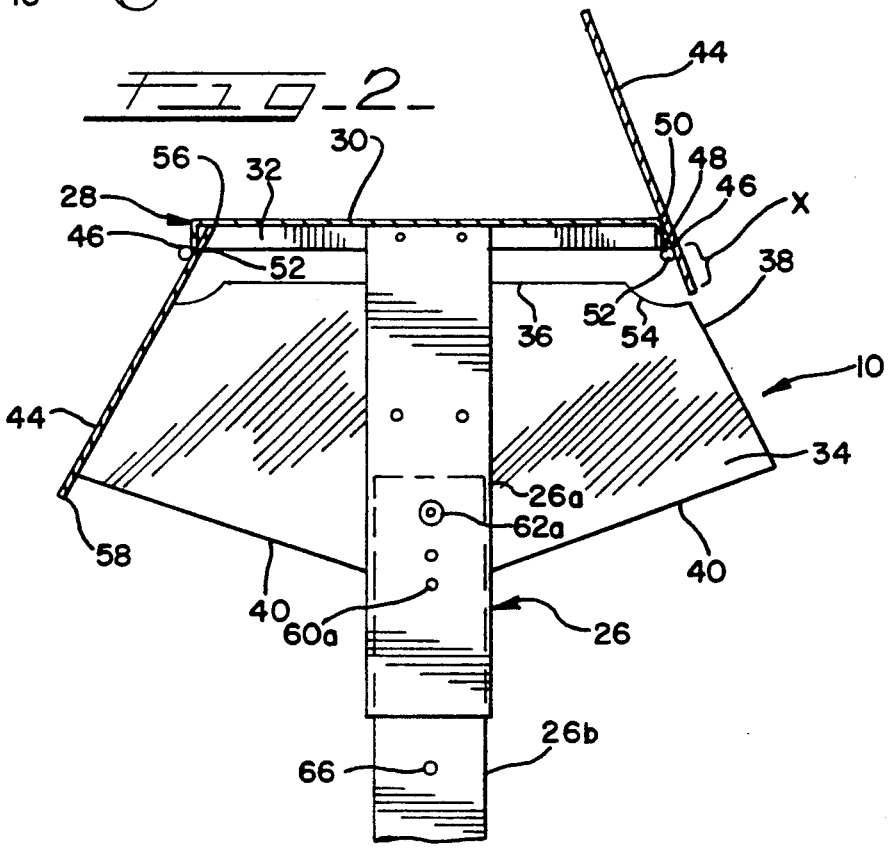
FIG. 2 is a cross-sectional view of the breath guard apparatus of FIG. 1 taken along the plane 2—2 of FIG. 1.

In this embodiment, when the side guard 44 is in the closed food shielding position, the upper edge 56 of the side guard 44 assumes a position under the cover 28, so that the upper edge 56 abuts the underside of the top shelf 30, as shown on the left side of FIG. 2.

Figure 3:
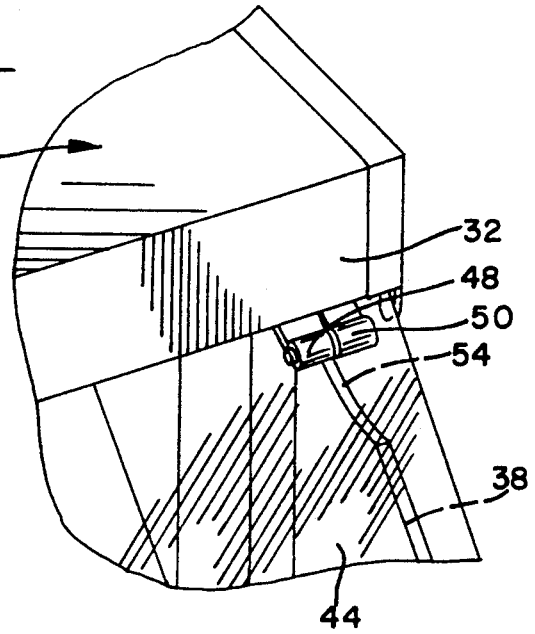
FIG. 3 is a partial perspective view of a portion of the apparatus showing an end guard in the closed position for shielding food.
Figure 4:
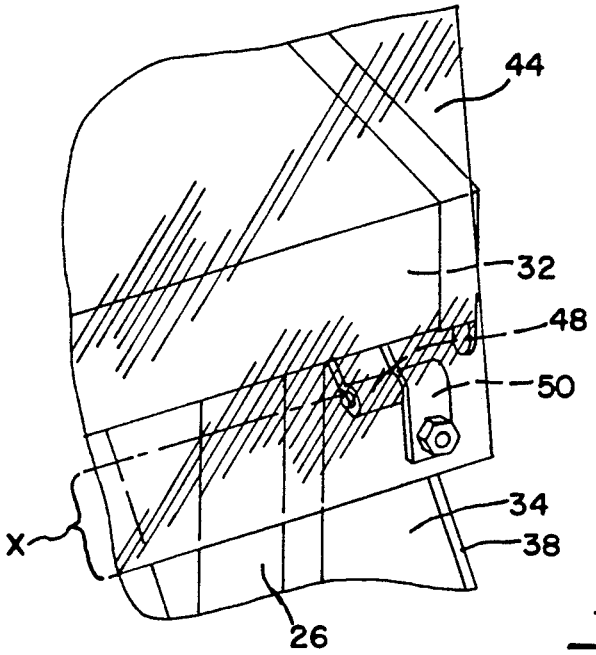
FIG. 4 is a partial perspective view of the same portion of the apparatus showing an end guard in the open position.

As can be seen in FIGS. 3 and 4, when the side guard 44 is in the closed position (FIG. 3), there is no opening in the breath guard apparatus between the side guard and the cover 28 which could enable airborne infections from customers to directly contact the various foods contained in the wells 20. This is achieved by the overlap of the side guard 44 over the sloped edge 38 of the end guard 34 and by positioning the upper perimeter portion of the side guard 44 (as defined by the distance (X)) underneath the cover 28 to avoid any opening between the side guard and the cover when the side guard is in the closed position. Thus, the distance X actually establishes the attitude of side guard 44 with respect to cover 28, and end guard 34 (if used) may be configured and positioned to substantially matingly abut side guard 44 to avoid such openings. The overlap of the side guard 44 over the end guard 34 is designated by the distance (Y) in FIG. 1.

Of course, side guard 44 and end guard 34 may be attached or integrally formed so that they move together. In such a configuration, when support members 26 are used, the distance X would preferably be selected to establish side guard 44 in its lowered position in an attitude appropriate for attached or integral end guards 34 to substantially matingly abut support member 26.

With reference to the location of the end guards 34, it should be noted that each end guard 34 along with the overlapping portion of the side guard (as defined by the distance (Y)) is located within the area outlined by the transverse ends 29 of the cover.

Since the height of the food dispensing opening defined by the distance between the lower edge 58 of the side guard 44 and the surface of the countertop 16 may vary according to various local health code requirements, the support members 26 are provided with a series of openings 60 which are aligned and spaced vertically from each other. These openings are adapted to receive a pin 62 to provide for height adjustment of the breath guard apparatus 10 relative to the countertop 16. The support members are inserted into sockets 64 in the countertop 16.

The support members 26 can be constructed from 18 gauge stainless steel and the cover 28 can be constructed from 18 gauge carbon steel. Moreover, these components can include a covering of wood grain vinyl or other plastic material. The support members 26 are usually adjusted so that the lower edge 58 of the side guard 44 is positioned about 12 inches or less above the countertop 16.

As an alternative to the use of openings 60 and pins 62 to provide adjustment for the height of the breath guard apparatus 10 over the surface of the countertop 16, FIG. 2 shows a support member 26 comprising a pair of members 26*a* and 26*b* which include a series of holes 60*a* and a pin 62*a* for adjusting the height of the breath guard apparatus 10. In practice, the member 26*a* comprises an outer sleeve member which slidably receives an inner sleeve member 26*b*.

To prevent the breath guard apparatus 10 from resting on the countertop 16, the support members can be provided with stop means 66, as shown in FIG. 2. The adjustments provided by the support members enable the breath guard apparatus 10 to be moved vertically and arranged from 9 to 15 inches from the countertop in one inch increments.

Figure 5:
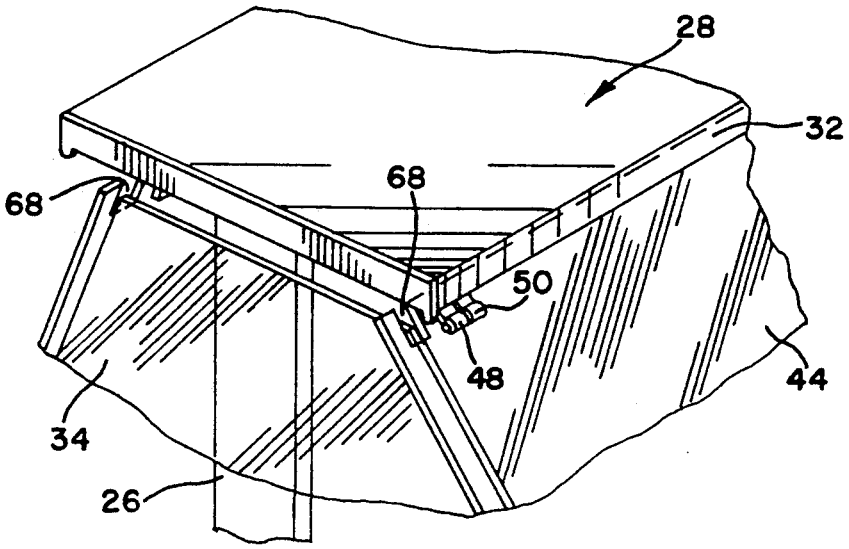
FIG. 5 is a partial perspective view of a second embodiment of the apparatus.

In another embodiment, the first and second hinge members 48 and 50 can be releasably connected by a hinge pin or pivot means of the slide-off style which is well known in the art. This permits the side guard 44 to be easily removed for cleaning purposes when located in the open position. Moreover, rather than using a cutaway portion 54 in the end guard 34 (as shown in FIG. 2), the side guard 44 may be modified as shown in FIG. 5 to include a slot 68 in the vicinity of the end guard 34 which provides the necessary clearance to swing the side guard past the end guard.

It should be understood that various modifications, changes and variations may be made in the arrangement, operation, and details of construction of the elements disclosed herein without departing from the spirit and scope of the invention.

What is claimed is:

1. An apparatus configured for use with a food service area for protecting food arrayed in said food service area, the apparatus comprising:

a shield means for shielding said food; and a support means for supporting said shield means;

said shield means being pivotably attached with said support means by at least one hinge means for effecting pivotable attachment;

said shield means being deployable in an operating position, said shield means depending from said support means in a predetermined attitude with respect to said support means when in said operating position;

said shield means having a first side and a second side, said at least one hinge means effecting said pivotable attachment intermediate said first side and said second side and establishing an extension of said shield means extending a first distance in a first direction from said at least one hinge means and an expanse extending a second distance in a second direction from said at least one hinge means, said first distance being less than said second distance, said extension engaging said support means when said shield means is in said operating position.

2. An apparatus configured for use with a food service area as recited in claim 1 wherein said first distance establishes said predetermined attitude.

3. An apparatus configured for use with a food service area as recited in claim 2 wherein said shield means is deployable in a maintenance position, said shield means having its center of gravity on a first side of a vertical plane substantially intersecting said at least one hinge means when in said operating position, said shield means having its center of gravity on said second side of said vertical plane when in said maintenance position.

4. An apparatus configured for use with a food service area as recited in claim 3 wherein each of said at least one shield member rotates about a pivot axis, and wherein said at least one hinge means is configured to release a particular shield member of said at least one shield member when said particular shield member is translationally moved in a predetermined direction along said pivot axis associated with said particular shield member.

5. An apparatus configured for use with a food service area as recited in claim 3 wherein said shield means comprises at least one shield member, each of said at least one shield member being a generally planar quadrilateral, said first side and said second side being opposite sides of each of said quadrilateral.

6. An apparatus configured for use with a food service area as recited in claim 3 wherein said shield means comprises at least one shield member, each of said at least one shield member comprising a unitary structure having a generally planar central area, said central area generally defining a quadrilateral bounded by said first side and said second side and by opposing ends, and an integral side shield member depending from at least one of said opposing ends toward said food service area.

7. An apparatus configured for use with a food service area as recited in claim 6 wherein the apparatus further comprises at least one support member extending from said support means to said food service area, said at least one support member suspending the apparatus above said food service area.

8. An apparatus configured for use with a food service area as recited in claim 7 wherein said side shield member engages said at least one support member when said shield means is in said operating position.

9. An apparatus configured for use with a food service area as recited in claim 7 wherein each of said at least one shield member rotates about a pivot axis, and wherein said at least one hinge means is configured to release a particular shield member of said at least one shield member when said particular shield member is translationally moved in a predetermined direction along said pivot axis associated with said particular shield member.

10. An apparatus configured for use with a food service area as recited in claim 2 wherein said shield means comprises at least one shield emmber, each of said at least one shield member being a generally planar quadrilateral, said first side and said second side being opposite sides of each of said quadrilateral.

11. An apparatus configured for usé with a food service area as recited in claim 2 wherein said shield means comprises at least one shield member, each of said at least one shield member comprising a unitary structure having a generally planar central area, said central area generally defining a quadrilateral bounded by said first side and said second side and by opposing ends, and an integral side shield member depending from at least one of said opposing ends toward said food service area.

12. An apparatus configured for use with a food service area as recited in claim 11 wherein the apparatus further comprises at least one support member extending from said support means to said food service area, said at least one support member suspending the apparatus above said food service area.

13. An apparatus configured for use with a food service area as recited in claim 12 wherein said side shield member engages said at least one support member when said shield means is in said operating position.

14. An apparatus configured for use with a food service area as recited in claim 1 wherein said shield means is deployable in a maintenance position, said shield means having its center of gravity on a first side of a vertical plane substantially intersecting said at least one hinge means when in said operating position, said shield means having its center of gravity on said second side of said vertical plane when in said maintenance position.

15. An apparatus configured for use with a food service area as recited in claim 1 wherein each of said at least one shield member rotates about a pivot axis, and wherein said at least one hinge means is configured to release a particular shield member of said at least one shield member when said particular shield member is translationally moved in a predetermined direction along said pivot axis associated with said particular shield member.

16. An apparatus configured for use with a food service area as recited in claim 15 wherein said shield means comprises at least one shield member, each of said at least one shield member being a generally planar quadrilateral, said first side and said second side being opposite sides of each of said quadrilateral.

17. An apparatus configured for use with a food service area as recited in claim 15 wherein said shield means comprises at least one shield member, each of said at least one shield member comprising a unitary structure having a generally planar central area, said central area generally defining a quadrilateral bounded by said first side and said second side and by opposing ends, and an integral side shield member depending from at least one of said opposing ends toward said food service area.

18. An apparatus configured for use with a food service area as recited in claim 17 wherein the apparatus further comprises at least one support member extending from said support means to said food service area, said at least one support member suspending the apparatus above said food service area.

19. An apparatus configured for use with a food service area as recited in claim 18 wherein said side shield emmber engages said at least one support emmber when said shield means is in said operating position.

20. An apparatus for protecting food displayed in a food service area comprising:

means for shielding the food including at least one transparent side guard;

means for supporting the shielding means above the food service area; and hinge means pivotably connecting the shielding means to the supporting means whereby the shielding means can be moved from a closed position such that food is protected, to an open position, such that the food is accessible and, in the open position, the shielding means remains pivotably connected to the support means;

the supporting means including a cover and the shielding means being connected to the cover by the hinge means;

the apparatus further including at least one end guard disposed below the cover which includes at least one sloped edge that supports the shielding means.

21. The apparatus according to claim 20 wherein the cover includes a downwardly extending flange and the shielding means includes a perimeter portion that extends partially under the downwardly extending flange.

22. The apparatus according to claim 21 wherein the hinge means comprises first and second members connected by pivot means, the first member being connected to the supporting means and the second member being connected to the shielding means.

23. The apparatus according to claim 22 wherein the second member of the hinge means is connected to the perimeter portion of the shielding means at a distance along the perimeter portion which corresponds to the distance the perimeter portion extends under the downwardly extending flange of the cover.

24. A breath guard apparatus for protecting food displayed in a food service area comprising:

means for shielding the food including at least one transparent side guard having a perimeter portion;

means for supporting the shielding means above the food service area including a cover having a flange along at least one side thereof;

hinge means connecting the perimeter portion of the side guard and the flange of the cover whereby the perimeter portion can extend under the flange and the side guard can be moved from a closed position, such that the food is protected, to an open position such that the side guard abuts the cover whereby the food is accessible;

the apparatus further including at least one end guard disposed below the cover which includes at least one sloped edge that supports the side guard.

25. A breath guard apparatus for a food service area comprising a cover having a flange along at least one transparent side thereof, at least one side guard including a perimeter portion that extends under the flange of the cover and hinge means connecting the side guard to the cover to rotatably position the perimeter portion of the side guard under the flange, the apparatus including a pair of support members for mounting the cover over the food service area, the apparatus further including a pair of end guards, each end guard being secured to one of the support members below the cover and including at least one sloped edge that supports the side guard, the sloped edge defining a cutaway portion corresponding to the perimeter portion of the side guard such that the perimeter portion is rotatable about the hinge means.

26. The apparatus according to claim 25 wherein the side guard overlaps the sloped edges of the end guards.

27. The apparatus according to claim 25 wherein the hinge means is attached to the side guard so that the side guard can be supported along the sloped edges of the end guards.

28. The apparatus according to claim 25 including means for adjusting the height of the support members relative to the food service area.

29. The apparatus according to claim 25 wherein the support members comprise telescoped members and means for extending the telescoped members.

30. The apparatus according to claim 29 including stop means for limiting the movement of at least one of the telescoped members.

31. The apparatus according to claim 25 wherein the sloped edge of each end guard extends outwardly and downwardly, a first member of the hinge means being connected to the flange of the cover and a second member of the hinge means being connected to the side guard at a distance along the perimeter portion whereby the side guard can be rotated to a closed position with each side guard being supported by the outwardly and downwardly sloped edges of the end guards or the side guard can be rotated to an open position.

32. The apparatus according to claim 31 wherein the sloped edge of each end guard defines a cutaway portion corresponding to the perimeter portion of the side guard such that the perimeter portion is rotatable about the hinge means.

* * * * *